US010634459B1

(12) United States Patent
Marcum et al.

(10) Patent No.: US 10,634,459 B1
(45) **Date of Patent: *Apr. 28, 2020**

(54) TACTICAL SHIELD HANDLE AND LIGHTING SYSTEM

(71) Applicant: Elzetta Design, LLC, Lexington, KY (US)

(72) Inventors: Bryan Thomas Marcum, Georgetown, KY (US); Toby Lee Carrier, Nicholasville, KY (US)

(73) Assignee: Elzetta Design, LLC, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/362,928

(22) Filed: Mar. 25, 2019

Related U.S. Application Data

(63) Continuation of application No. 15/949,238, filed on Apr. 10, 2018, now Pat. No. 10,288,387.

(60) Provisional application No. 62/483,500, filed on Apr. 10, 2017.

(51) Int. Cl.

| | |
|---|---|
| ***F41H 5/08*** | (2006.01) |
| ***F21V 19/00*** | (2006.01) |
| ***F21L 4/02*** | (2006.01) |
| ***F21V 23/06*** | (2006.01) |
| ***F21V 33/00*** | (2006.01) |
| ***F21V 23/04*** | (2006.01) |
| *F21Y 115/10* | (2016.01) |
| *F21W 131/40* | (2006.01) |

(52) U.S. Cl.
CPC ..... *F41H 5/08* (2013.01); *F21L 4/02* (2013.01); *F21V 19/005* (2013.01); *F21V 23/0414* (2013.01); *F21V 23/06* (2013.01); *F21V 33/0076* (2013.01); *F21W 2131/40* (2013.01); *F21Y 2115/10* (2016.08)

(58) Field of Classification Search
CPC ..... F41H 5/08; F21V 23/0414; F21V 33/0076
See application file for complete search history.

(56) References Cited

U.S. PATENT DOCUMENTS 6,220,916 B1 * 4/2001 Bart ..... A63H 33/00 434/393

OTHER PUBLICATIONS

Microchip Technology Inc. AN1626. pp. 1-6, published 2013 (Year: 2013).*

* cited by examiner

*Primary Examiner* — Evan P Dzierzynski
(74) *Attorney, Agent, or Firm* — Stites & Harbison, PLLC; David W. Nagle, Jr.

(57) ABSTRACT

A handle and lighting system for a tactical shield includes a handle assembly configured to be mounted on the shield. The handle assembly includes a central horizontal handle, a first side handle on one side, and a second side handle on an opposite side. The handle and lighting system also includes a lighting enclosure housing one or more light sources and configured to be mounted on the shield. The handle and lighting system also includes a first switch mounted on the central horizontal handle, a second switch mounted near a top of the first side handle, and a third switch mounted near a top of the second side handle, which are used to activate or deactivate the one or more light sources.

13 Claims, 11 Drawing Sheets

TACTICAL SHIELD HANDLE AND LIGHTING SYSTEM

CROSS-REFERENCE TO RELATED APPLICATIONS

The present application is a continuation of U.S. patent application Ser. No. 15/949,238 filed on Apr. 10, 2018, which claims priority to U.S. Patent Application Ser. No. 62/483,500 filed on Apr. 10, 2017, the entire disclosures of which are incorporated herein by reference.

BACKGROUND OF THE INVENTION

The present invention relates to tactical shields, and, more particularly, handles and lighting systems for such tactical shields.

In recent years, the increasing complexity of tactical operations, gear, and standards have generated the need for a versatile multi-use handle for tactical shields with a level of lighting integration that provides simplified operation and is not prone to failure due to exposed wire leads or switches. As a result, a wide variety of lighting systems have been developed, most of which are designed to be retrofitted onto existing tactical shields. These lighting systems typically utilize a mechanical pressure pad-style switch tethered to a wire harness, which is then affixed to the existing shield handle at a location chosen by the operator. These systems also incorporate a light-emitting diode (LED) or array of LEDs mounted in some form of enclosure that is secured to the front of the shield. For instance, both the lighting enclosure and switch could be mounted using typical hook-and-loop style fasteners or other known fastening means. In addition, lighting systems have been developed which are intended to be installed by the shield manufacturer, rather than retrofitted by the operator. In that case, the shields may be provided with pre-designed holes that accommodate bolts or similar fasteners for mounting the lighting enclosure to the front of the shield.

Lighting systems installed by the shield manufacturer often also include some type of horizontal handle, such that the operator holds and supports the shield via an underhanded grip. The palm of the operator's hand supports the underside of the handle, while the operator's arm remains vertical, such that the elbow is used as means of support, and the shield remains substantially parallel to the operator's torso. The mechanical disadvantage of such a handle design is with respect to left-to-right rotation ability. Such rotation is severely limited by the strength of the operator's wrist and the ability to maneuver the weight of the shield in a tactical situation in an effort to keep any potential threats in the center of the operator's view or in negotiating turns in a building while remaining protected. An additional notable disadvantage of this style of handle is that the shield must be held a distance from the operator's torso, as a result of the forearm and upper arm both being positioned between the operator and the shield. At the same time, it is worth noting that such a handle has an advantage in that the handle itself remains largely above the operator's chest area without obstruction below the wrist. This is particularly useful if the operator has any type of gear bag or vest with additional bulky items requiring clearance between the torso and shield.

Other handle designs also exist in the art, some of which allow ambidextrous use with forearm support via a tri-handle design, with a central horizontal handle and two substantially vertical side handles on either side of the central horizontal handle. This allows the operator to grasp the central horizontal handle to hold and support the shield via an underhanded grip, as described above. Alternatively, the operator can grasp one of the side handles in a cross-hold orientation. In a cross-hold orientation, the operator grasps one of the side handles, and the forearm is then engaged by a forearm support. In such tri-handle design, the forearm support is typically in the form of a rigid cuff, which is fixed in nature and can serve as an obstruction to gear bags when the tri-handle is operated in the horizontal arrangement. In any event, the significant mechanical advantage of such tri-handle design is the increased mobility offered by the cross-hold. This allows the entire forearm strength to be used to turn the shield left to right in a tactical situation, rather than the operator's wrist. An additional advantage is the proximity improvement with respect to the operator's torso, as the forearm is the only part of the body between the shield and torso. While better control is afforded left to right, cross-hold operation does impart a natural shield imbalance due to the weight of the viewport (if used). This increases operator fatigue on the wrist and forearm due to top-heavy nature of shields. This may be offset by various means, such as wrist supports, padding, or stabilizing the shield with one's shooting arm on the side of the shield.

Furthermore, known tri-handle designs require the use of retrofit lighting systems, which often incorporate an external switch and wires, which are potential failure points. In addition, for known systems, one pressure switch is provided which must be affixed in accordance with the intended hold method and is not ambidextrous once installed. If the mission or tactical requirement changes, this forces the operator to reposition the switch and means of attachment. Also, as mentioned above, to the extent cuffs are used for forearm supports, they are typically rigid and fixed, which can create a significant obstruction when the cuff is not being used. The unused cuffs can also create snag points and/or discomfort for the operator.

SUMMARY OF THE INVENTION

The present invention is a tactical shield handle and lighting system, which includes a stable, ambidextrous tri-handle design, and which allows an operator to readily operate and activate one or more lights by accessing one of three on/off switches. Depending upon the hold technique utilized, the time required to locate the on/off mechanism is substantially reduced, field modifications or reconfigurations prior to use for switch placement are eliminated, and the versatility and simplicity of the handle system is substantially increased. Specifically, the handle may be used by the operator, left or right-handed, in the field, for either a vertical-hold orientation or a cross-hold orientation, with movable forearm supports which eliminate any obstruction (as compared to rigid cuffs) when the vertical-hold technique is used. In addition, each switch is preferably dependently operated, such that each switch may activate or deactivate the light(s) regardless of order pressed, which ultimately reduces operation complexity and confusion in stressful tactical situations. In short, any switch may be used to activate or deactivate the light(s).

An exemplary tactical shield handle and lighting system made in accordance with the present invention thus includes a handle assembly that is mounted to a rear surface of the tactical shield, with a central horizontal handle and first and second side handles on either side of the central horizontal handle. Furthermore, the handle and lighting system also includes a pair of cuffs, one of which is positioned at the lower distal end of each of the first and second side handles. Each of these cuffs can serve as a forearm support, and each of these cuffs is mounted for rotation about a substantially horizontal axis.

The handle and lighting system also includes a lighting enclosure that is secured to a front surface of the tactical shield. This lighting enclosure houses one or more light sources, such as light-emitting diodes (LEDs). Bolts or similar fasteners are used to secure to the lighting enclosure to the handle assembly through the shield.

In some embodiments, three switches are included in the handle assembly. The first switch is mounted on the central horizontal handle. The second switch is mounted near the top of the first side handle, and the third switch is mounted near the top of the second side handle. As mentioned above, each switch is dependently operated, such that each switch may activate or deactivate the light sources. Furthermore, it is preferred that any switch may be used to activate the light sources in a momentary mode by simply depressing and releasing prior to a predefined time limit. Any switch may also be used to activate the light sources in a constant-on mode by pressing longer than the predefined time limit. To accomplish such functionality, an integrated circuit or programmable microcontroller is used, which receives and acts on the inputs from each of the switches.

In some embodiments, a power source (e.g., batteries) is housed in the handle assembly. The power source is electrically connected to a first (negative) contact, which is secured to an exterior surface of the handle assembly. The power source is also electrically connected to a second (positive) contact, which is secured to an exterior surface of the handle assembly. A first (negative) contact is secured to an exterior surface of the lighting enclosure, and a second (positive) contact is similarly secured to an exterior surface of the lighting enclosure. The one or more light sources are electrically connected to the first (negative) contact and the second (positive) contact. A first spring is then used to bridge and connect the first (negative) contact that is secured to the handle assembly to the first (negative) contact that is secured to the lighting enclosure. Similarly, a second spring is used to bridge and connect the second (positive) contact that is secured to the handle assembly to the second (positive) contact is secured to the lighting enclosure. Thus, when the handle assembly and the lighting enclosure are assembled and mounted to the tactical shield, the power source is electrically connected to the one or more light sources.

DETAILED DESCRIPTION OF THE INVENTION

The present invention is a tactical shield handle and lighting system, which includes a stable, ambidextrous tri-handle design, and which allows an operator to readily operate and activate one or more lights by accessing one of three on/off switches. Depending upon the hold technique utilized, the time required to locate the on/off mechanism is substantially reduced, field modifications or reconfigurations prior to use for switch placement are eliminated, and the versatility and simplicity of the handle system is substantially increased. Specifically, the handle may be used by the operator, left or right-handed, in the field, for either a vertical-hold orientation or a cross-hold orientation, with movable forearm supports which eliminate any obstruction (as compared to rigid cuffs) when the vertical-hold technique is used. In addition, each switch is preferably dependently operated, such that each switch may activate or deactivate the light(s) regardless of order pressed, which ultimately reduces operation complexity and confusion in stressful tactical situations. In short, any switch may be used to activate or deactivate the light(s).

Furthermore, any switch may be used to activate the light in a momentary mode by simply depressing and releasing prior to a predefined time limit (e.g., three seconds). Any switch may also be used to activate the light in a constant-on mode by pressing longer than the predefined time limit. Furthermore, after the predefined time limit, any switch may deactivate or cancel the constant-on mode.

Figure 1:
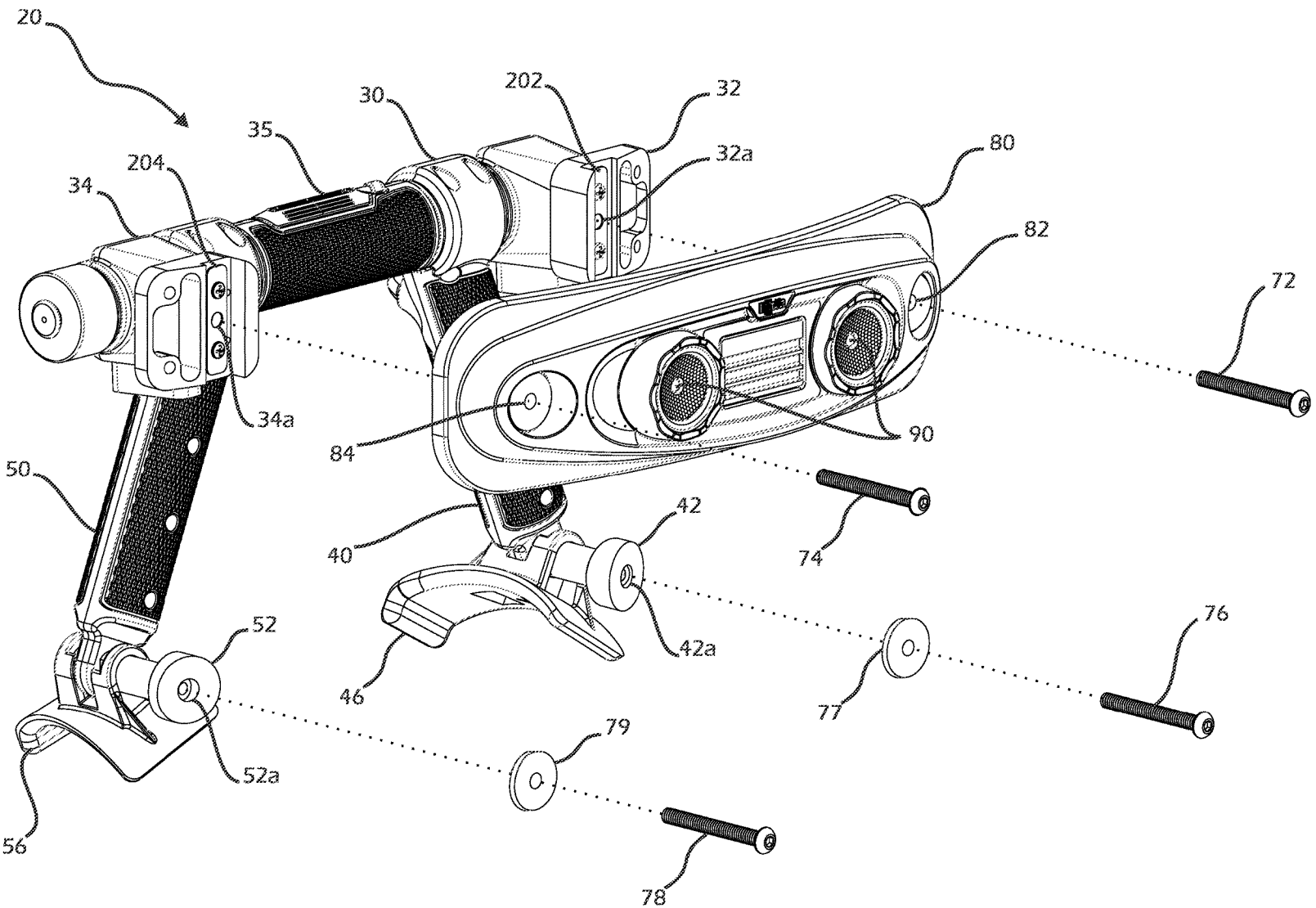
FIG. 1 is an exploded perspective view of an exemplary tactical shield handle and lighting system made in accordance with the present invention.
Figure 2:
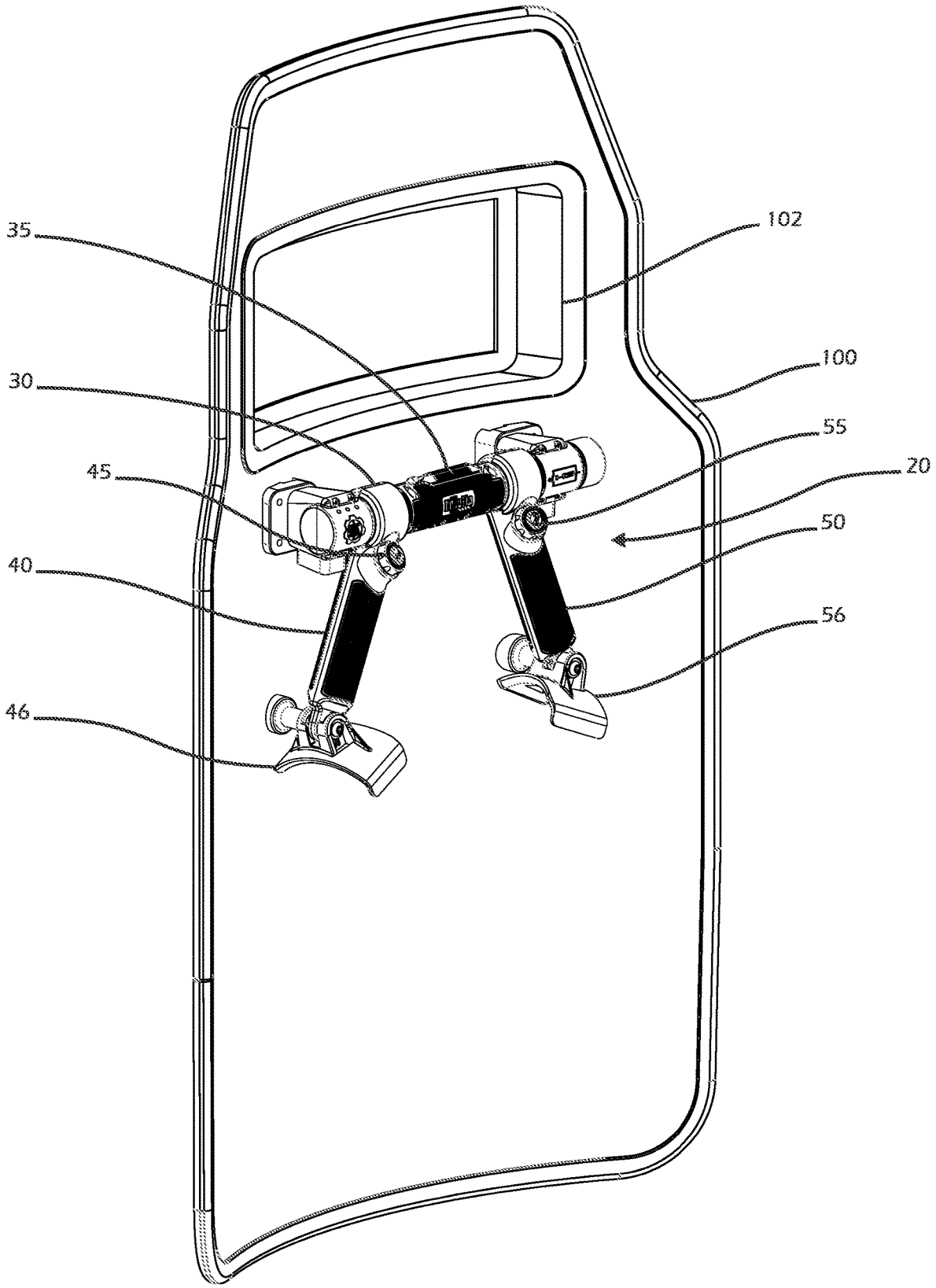
FIG. 2 is a rear perspective view of the exemplary tactical shield handle and lighting system of FIG. 1 as mounted on a tactical shield.
Figure 3:
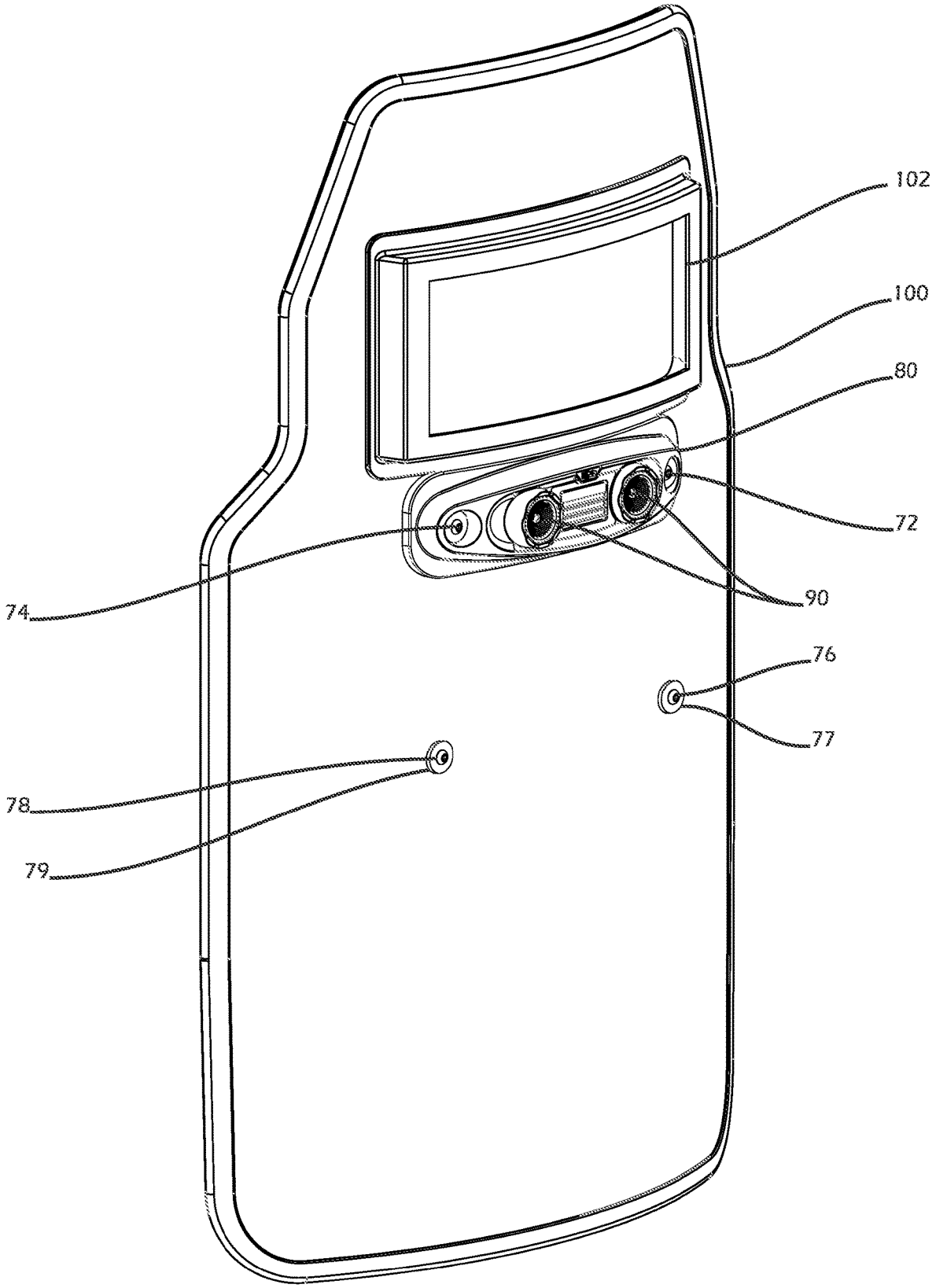
FIG. 3 is a front perspective view of the exemplary tactical shield handle and lighting system of FIG. 1 as mounted on a tactical shield.

FIG. 1 is an exploded perspective view of an exemplary tactical shield handle and lighting system 10 made in accordance with the present invention FIG. 2 is a rear perspective view of the exemplary tactical shield handle and lighting system 10 as mounted on a tactical shield 100 with viewport 102, and FIG. 3 is a front perspective view of the exemplary tactical shield handle and lighting system 10 as mounted on the tactical shield 100.

Referring now to FIGS. 1-3, the handle and lighting system 10 includes a handle assembly 20, with central horizontal handle 30 and first and second side handles 40, 50 on either side of the central horizontal handle 30. In this exemplary embodiment, each of the first and second side handles 40, 50 extends downwardly (in a generally vertical orientation) from a respective distal end of the central horizontal handle 30, which, as described below, is optimal for the cross-hold orientation. Furthermore, as shown in FIGS. 1 and 2, the handle and lighting system 10 also includes cuffs 46, 56, one of which is positioned at the lower distal end of each of the first and second side handles 40, 50. Each of these cuffs 46, 56 can serve as a forearm support (as further described below), and each of these cuffs 46, 56 is mounted for rotation about a substantially horizontal axis. Finally, three switches 35, 45, 55 are included in the handle assembly 20, as will be further described below.

As shown in FIGS. 1 and 3, the handle and lighting system 10 also includes a lighting enclosure 80 that is secured to a front surface of the shield 100. This lighting enclosure 80 houses one or more light sources 90, which, in this exemplary embodiment, are light-emitting diodes (LEDs).

Referring again to FIG. 1, in this exemplary embodiment, two bolts 72, 74 are used to secure to the lighting enclosure 80 to the handle assembly 20 (through the shield 100). Specifically, and as shown in FIG. 1, the handle assembly 20 includes an attachment block 32, 34 at each end of the central horizontal handle 30. Each of these attachment blocks 32, 34 defines a threaded hole 32*a*, 34*a* for receiving one of the respective bolts 72, 74. Thus, each bolt 72, 74 passes through a respective hole 82, 84 defined through the lighting enclosure 80, through the shield 100 (as shown in FIGS. 2 and 3), and then into the respective threaded hole 32*a*, 34*a* defined by the attachment blocks 32, 34 of the handle assembly 20.

Referring still to FIG. 1, it should also be recognized that, in this exemplary embodiment, each of the attachment blocks 32, 34 has a wide flange for engaging the rear surface of the shield 100 (see FIG. 2). Because each threaded hole 32*a*, 34*a* is defined and enclosed within the respective attachment block 32, 34, if the head of one of the bolts 72, 74 is struck by a round, the remaining threaded portion of the bolt 72, 74 cannot become a secondary projectile and strike the operator. Furthermore, if a round does not strike the head of one of the bolts 72, 74, but somehow strikes another surface at an angle and "sneaks" through one of the holes cut into the shield for mounting the tactical shield handle and lighting system 10, the wide flange of each attachment block 32, 34 serves as a "backstop" and protects the operator.

Referring still to FIG. 1, in this exemplary embodiment, there are also two lower bolts 76, 78, which pass through respective washers 77, 79 through the shield 100 (see FIG. 2), and into the handle assembly 20. The handle assembly 20 includes an attachment post 42, 52 at the lower distal end of each of the first and second side handles 40, 50. Each of these attachment posts 42, 52 has a wide flange for engaging the rear surface of the shield 100 (see FIG. 2) and defines a threaded hole 42*a*, 52*a* for receiving one of the respective bolts 76, 78. Because each threaded hole 42*a*, 52*a* is defined and enclosed within the respective attachment post 42, 52, if the head of one of the bolts 76, 78 is struck by a round, the remaining threaded portion of the bolt 76, 78 cannot become a secondary projectile and strike the operator. Furthermore, if a round does not strike the head of one of the bolts 76, 78, but somehow strikes another surface at an angle and "sneaks" through one of the holes cut into the shield for mounting the tactical shield handle and lighting system 10, similar to the attachment blocks 32, 34 described above, the wide flange of each attachment post 42, 52 serves as a "backstop" and protects the operator.

Figure 4:
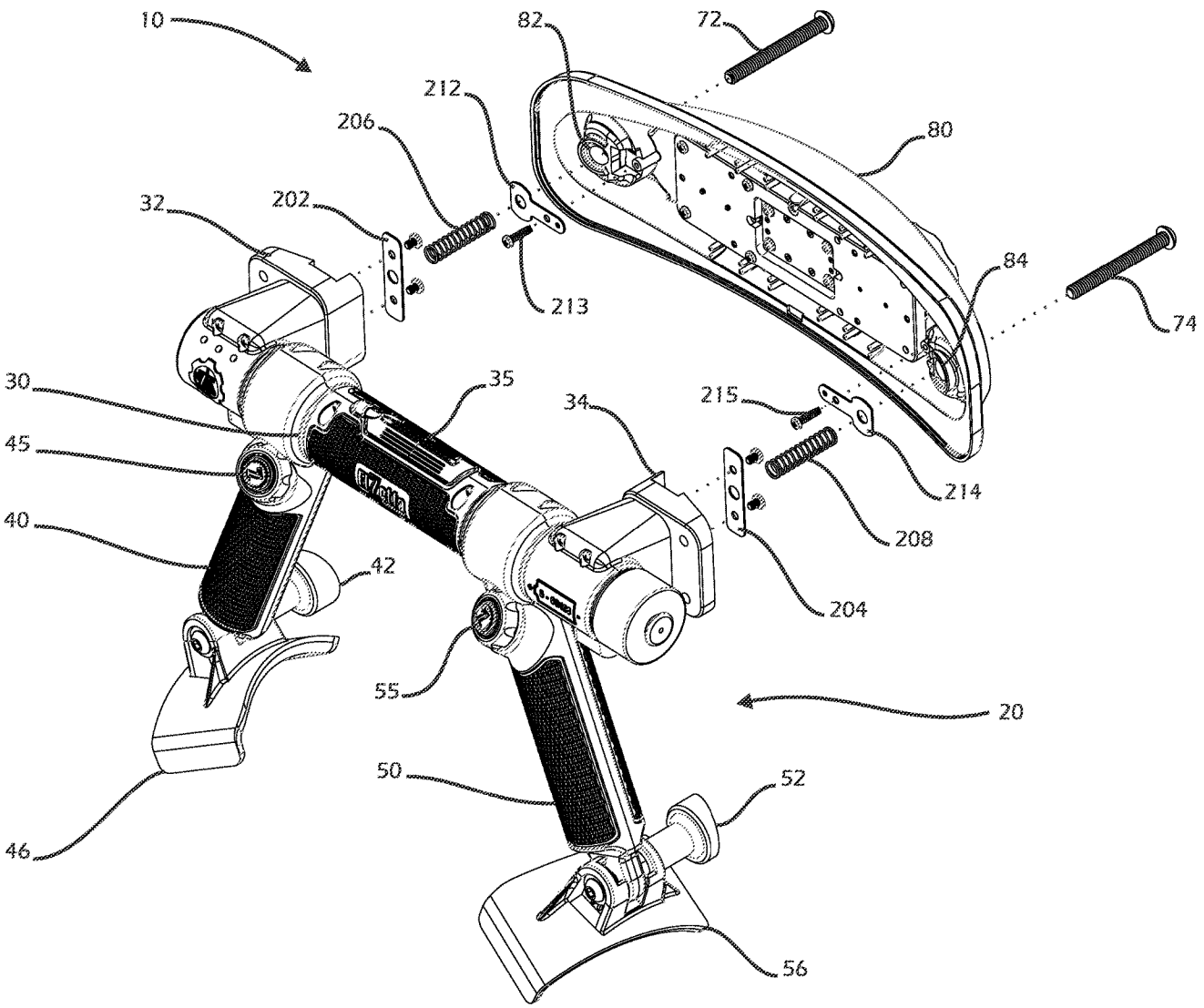
FIG. 4 is a partial exploded perspective view of the exemplary tactical shield handle and lighting system of FIG. 1.

FIG. 4 is a partial exploded perspective view of the exemplary tactical shield handle and lighting system 10 that similarly illustrates the use of bolts 72, 74 to secure to the lighting enclosure 80 to the handle assembly 20 (through the shield 100). Furthermore, FIG. 4 illustrates certain components of the electrical system in this exemplary embodiment.

Figure 4A:
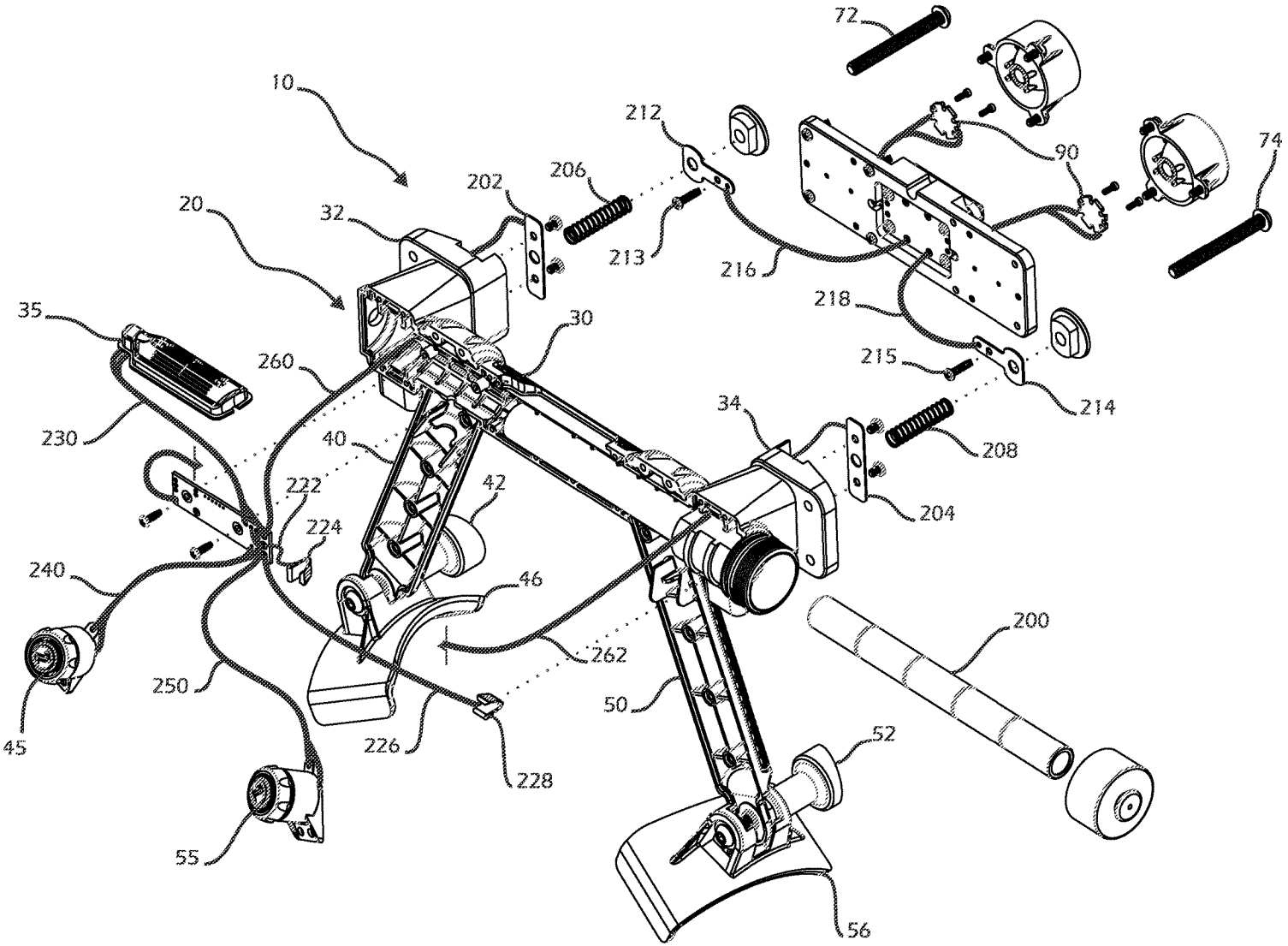
FIG. 4A is a view similar to FIG. 4, but with certain portions of the physical structure removed to further illustrate certain components of the electrical system.

FIG. 4A is a view similar to FIG. 4, but with certain portions of the physical structure removed to further illustrate certain components of the electrical system in this exemplary embodiment.

Referring now to FIGS. 4 and 4A, in this exemplary embodiment, a power source (e.g., batteries) 200 is housed in the handle assembly 20. The power source 200 is electrically connected to a first (negative) contact 202, as further described below. The first (negative) contact 202 is secured to the attachment block 32 of the handle assembly 20 by one or more fasteners. The power source 200 is also electrically connected to a second (positive) contact 204, as further described below. The second (positive) contact 204 is similarly secured to the other attachment block 34 of the handle assembly 20 by one or more fasteners. Referring again to FIG. 1, each of the first (negative) contact 202 and the second (positive) contact 204 is on an exterior surface of the respective attachment blocks 32, 34, the importance of which will be further described below.

Referring again to FIGS. 4 and 4A, a first (negative) contact 212 is secured to one end of the lighting enclosure 80 by at least one fastener 213, and a second (positive) contact 214 is similarly secured to an opposite end of lighting enclosure 80 by at least one fastener 215. Each of the first (negative) contact 212 and the second (positive) contact 214 are on an exterior surface of the lighting enclosure 80, the importance of which will be further described below. Furthermore, the one or more light sources 90 (e.g., LEDs) are electrically connected to the first (negative) contact 212 and the second (positive) contact 214, preferably via wires 216, 218 housed within the lighting enclosure 80.

Referring again to FIGS. 4 and 4A, a first spring 206 is used to bridge and connect the first (negative) contact 202 that is secured to the attachment block 32 of the handle assembly 20 to the first (negative) contact 212 is secured to the one end of the lighting enclosure 80. Similarly, a second spring 208 is used to bridge and connect the second (positive) contact 204 that is secured to the attachment block 34 of the handle assembly 20 to the second (positive) contact 214 is secured to the opposite end of the lighting enclosure 80. Thus, when the handle assembly 20 and the lighting enclosure 80 are assembled and mounted to the tactical shield 100 (as shown in FIGS. 2 and 3), the power source 200 is electrically connected to the one or more light sources 90. In this regard, the springs 206, 208 are not only rugged means for providing the electrical connection, but the springs 206, 208 also accommodate different shield thicknesses, as they are much longer than the gap they need to bridge between the respective contacts.

Referring again to FIGS. 1, 4, and 4A, as mentioned above, three switches 35, 45, 55 are included in the handle assembly 20. The first switch 35 is mounted on the central horizontal handle 30. The second switch 45 is mounted near the top of the first side handle 40, and the third switch 55 is mounted near the top of the second side handle 50. In this exemplary embodiment, the switches 45, 55 mounted near the tops of the first and second side handles 40, 50 are momentary spring-loaded (or "push-button") mechanical switches. However, in this exemplary embodiment, the switch 35 mounted on the central horizontal handle 30 is a metal-over-capacitive touch (MOCT) switch.

Figure 5:
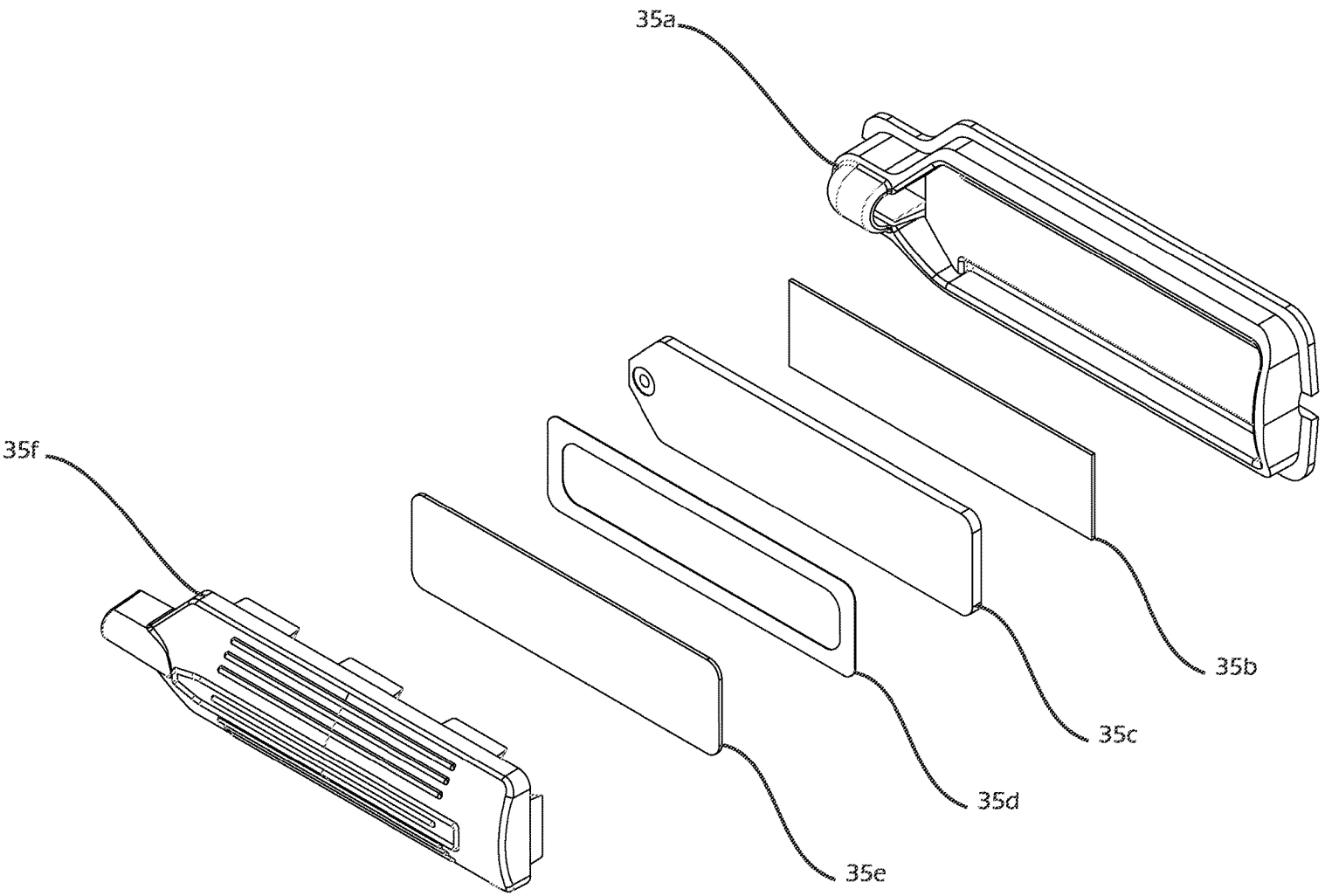
FIG. 5 is an exploded perspective view that details the construction of the metal-over-capacitive touch (MOCT) switch that is incorporated into the exemplary tactical shield handle and lighting system of FIG. 1.

FIG. 5 is an exploded perspective view that details the construction of the metal-over-capacitive touch (MOCT)

switch. As shown in FIG. 5, the switch 35 includes a base member 35*a*, which receives and encloses a series of layers that form the switch 35. Specifically, in this exemplary embodiment, there is layer of double-sided tape 35*b* that secures a printed circuit board 35*c* to and within the base member 35*a*. The printed circuit board 35*c* includes sensor electrodes (not shown) on its upper surface that measure capacitance. Another layer of double-sided tape 35*d* is then placed over the upper surface of the printed circuit board 35*c*, but this layer of double-sided tape 35*d* is open in the middle and thus serves as a spacer between the printed circuit board 35*c* and a layer of conductive material 35*e*. Finally, a flexible top cover 35*f* is operably connected to the base member 35*a* and completes the assembly of the switch 35. In use, when an operator applies pressure to the top cover 35*f*, that pressure causes a deflection or deformation of the layer of conductive material 35*e* below the top cover 35*f*. This deflection or deformation of the layer of conductive material 35*e* toward the printed circuit board 35*c* causes a change in capacitance, which is detected by the electrodes on the upper surface of the printed circuit board 35*c*, thus closing (or opening) the switch 35.

In this exemplary embodiment, and as mentioned above, each switch 35, 45, 55 is dependently operated, such that each switch 35, 45, 55 may activate or deactivate the light sources 90. Furthermore, as also mentioned above, it is preferred that any switch 35, 45, 55 may be used to activate the light sources 90 in a momentary mode by simply depressing and releasing prior to a predefined time limit (e.g., three seconds). Any switch 35, 45, 55 may also be used to activate the light sources 90 in a constant-on mode by pressing longer than the predefined time limit. Furthermore, after the predefined time limit, any switch 35, 45, 55 may deactivate or cancel the constant-on mode. To accomplish such functionality, an integrated circuit or programmable microcontroller is used, which receives and acts on the inputs from each of the switches 35, 45, 55.

Figure 6:
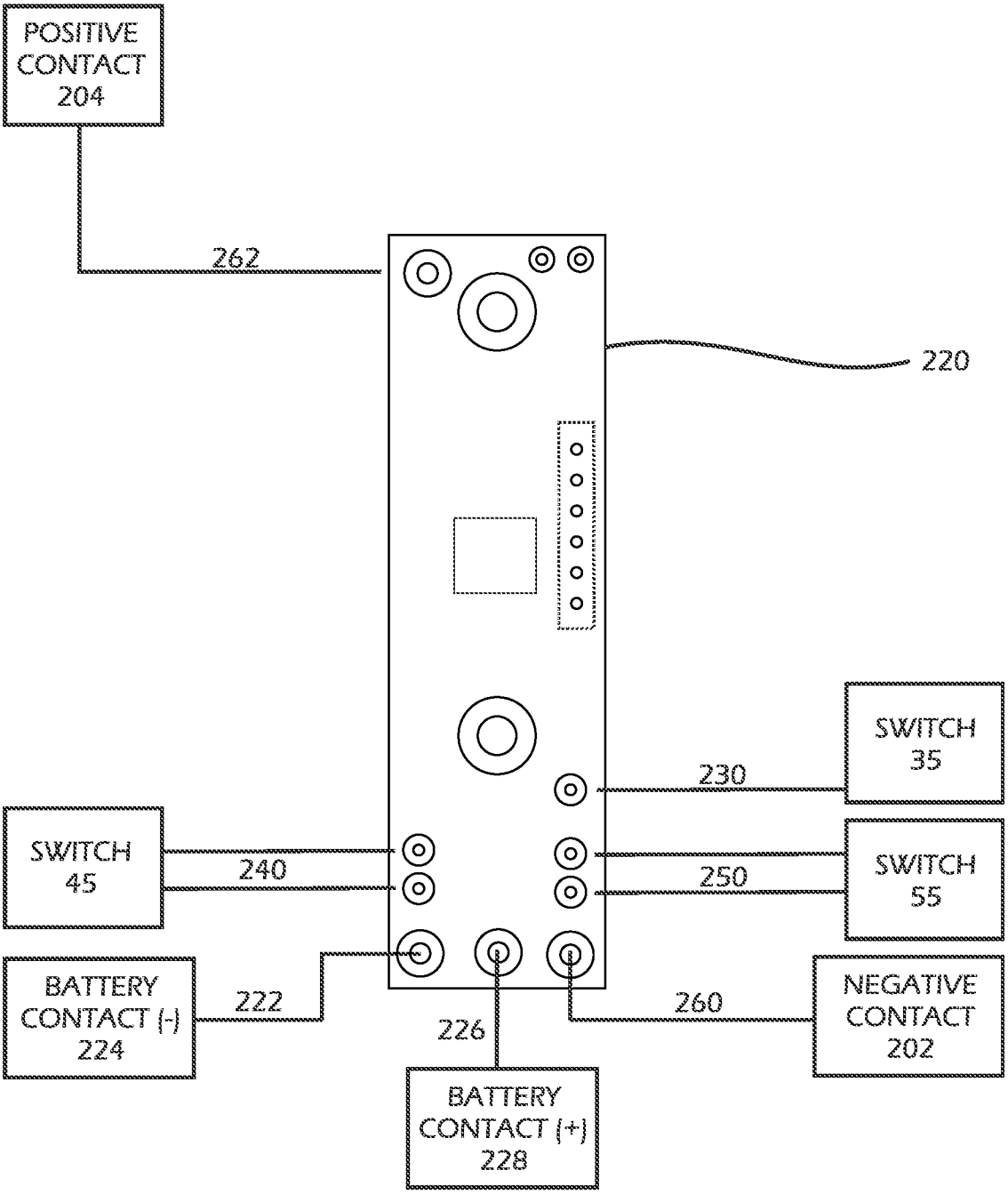
FIG. 6 is a schematic view of an exemplary programmable microcontroller used in the exemplary tactical shield handle and lighting system of FIG. 1.

FIG. 6 is schematic view of an exemplary programmable microcontroller 220 (which is preferably housed in the central horizontal handle 30 of the handle assembly 20) for use with the tactical shield handle and lighting system 10 of the present invention. As shown, the programmable microcontroller 220 is connected to and powered by the power source (e.g., batteries) 200 via contacts 224, 228. In this regard, and referring also to FIG. 4A, in this exemplary embodiment, there is a wire 222 that connects the programmable microcontroller 220 to the contact 224, which engages the positive terminal of the power source 200. Similarly, there is a wire 226 that connects the programmable microcontroller 220 to the contact 228, which engages the negative terminal of the power source 200.

Referring still to FIG. 6 and FIG. 4A, the switch 45 is electrically connected to the programmable microcontroller 220 by a pair of wires 240, and the switch 55 is electrically connected to the programmable microcontroller 220 by a pair of wires 250. Furthermore, the switch 35 (which, as described above, is a metal-over-capacitive touch (MOCT) switch) is also connected to the programmable microcontroller 220 by a pair of wires 230.

Referring still to FIG. 6 and FIG. 4A, the programmable microcontroller 220 is electrically connected to the first (negative) contact 202 by a wire 260, and the programmable microcontroller 220 is electrically connected to the second (positive) contact 204 by a wire 262.

The above-described use of the programmable microcontroller 220 and particular arrangement of wiring and electrical connections is provided solely for purposes of example, and other means could be used to accomplish the desired functionality without departing from the spirit and scope of the present invention.

Figure 7:
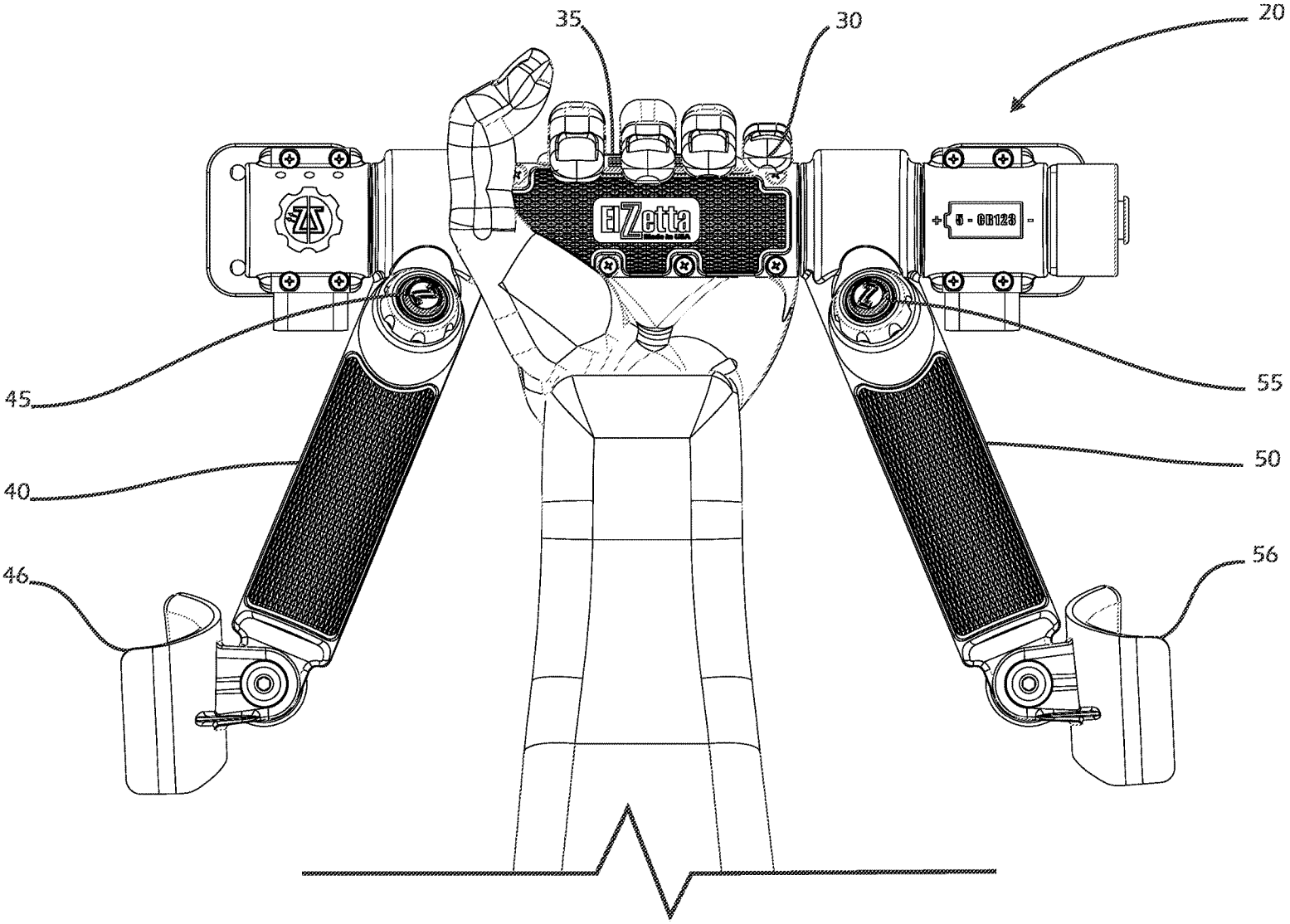
FIG. 7 is a rear view of the handle assembly of the exemplary tactical shield handle and lighting system of FIG. 1, illustrating how an operator would grasp and maneuver the shield in the vertical-hold orientation.

Returning now to a discussion of the hold and support of the tactical shield 100 by an operator, FIG. 7 is a rear view of the handle assembly 20 of the exemplary tactical shield handle and lighting system 10, illustrating how an operator would grasp and maneuver the shield in the vertical-hold orientation. As shown, the operator is grasping the central horizontal handle 30, and the cuffs 46, 56 have been rotated so as to not be an obstruction to the operator.

Figure 8:
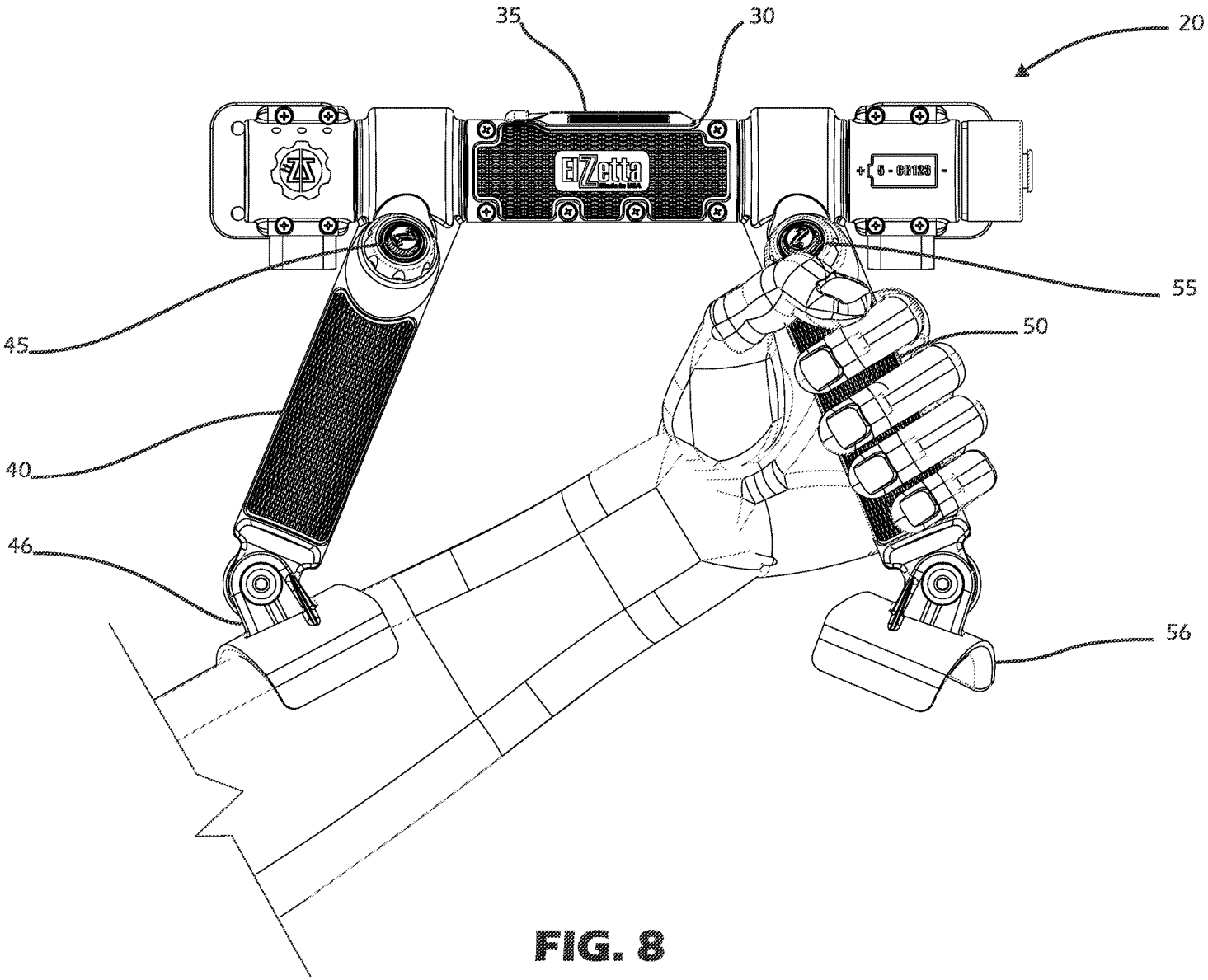
FIG. 8 is a rear view of the handle assembly of the exemplary tactical shield handle and lighting system of FIG. 1, illustrating how an operator would grasp and maneuver the shield in the cross-hold orientation.

FIG. 8 is a rear view of the handle assembly 20 of the exemplary tactical shield handle and lighting system 10, illustrating how an operator would grasp and maneuver the shield in the cross-hold orientation. In the cross-hold orientation, the operator is grasping the second side handle 50, and the first cuff 46 has been rotated to engage the forearm of the operator. Of course, an operator may choose to use his right arm to hold the shield, in which case, the operator would grasp the first side handle 40, and the second cuff 56 would be rotated to engage the forearm of the operator.

As described above, and as should be clear from FIGS. 7 and 8, irrespective of how the shield is held and by which arm, the operator can readily activate or deactivate the light sources 90 (see FIG. 2) by using the most convenient switch 35, 45, 55.

Figure 9:
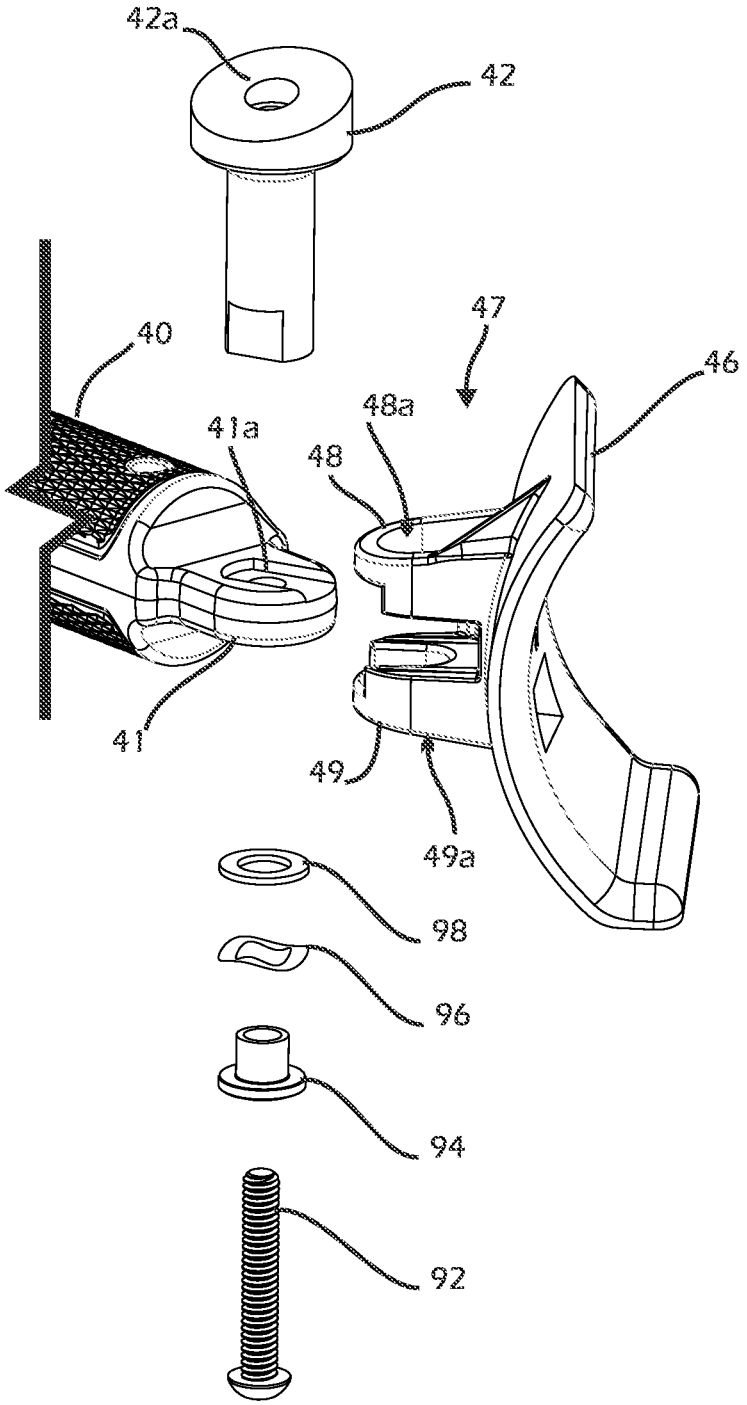
FIG. 9 is an exploded perspective view of one of the cuffs of the exemplary tactical shield handle and lighting system of FIG. 1, illustrating its attachment to a side handle.
Figure 10:
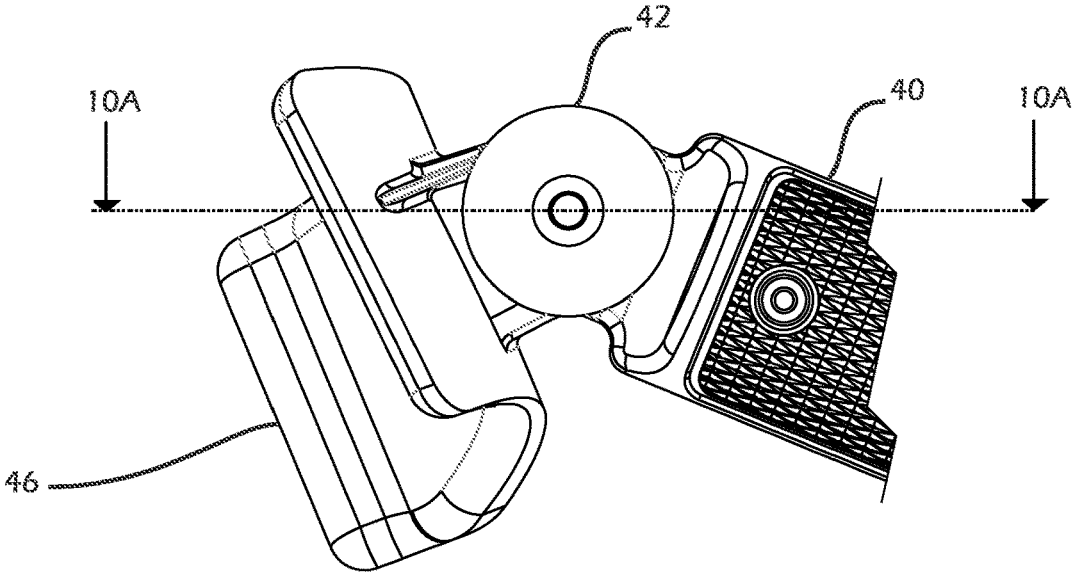
FIG. 10 is an enlarged view that illustrates attachment of one of the cuffs to a side handle in the exemplary tactical shield handle and lighting system of FIG. 1.
Figure 10A:
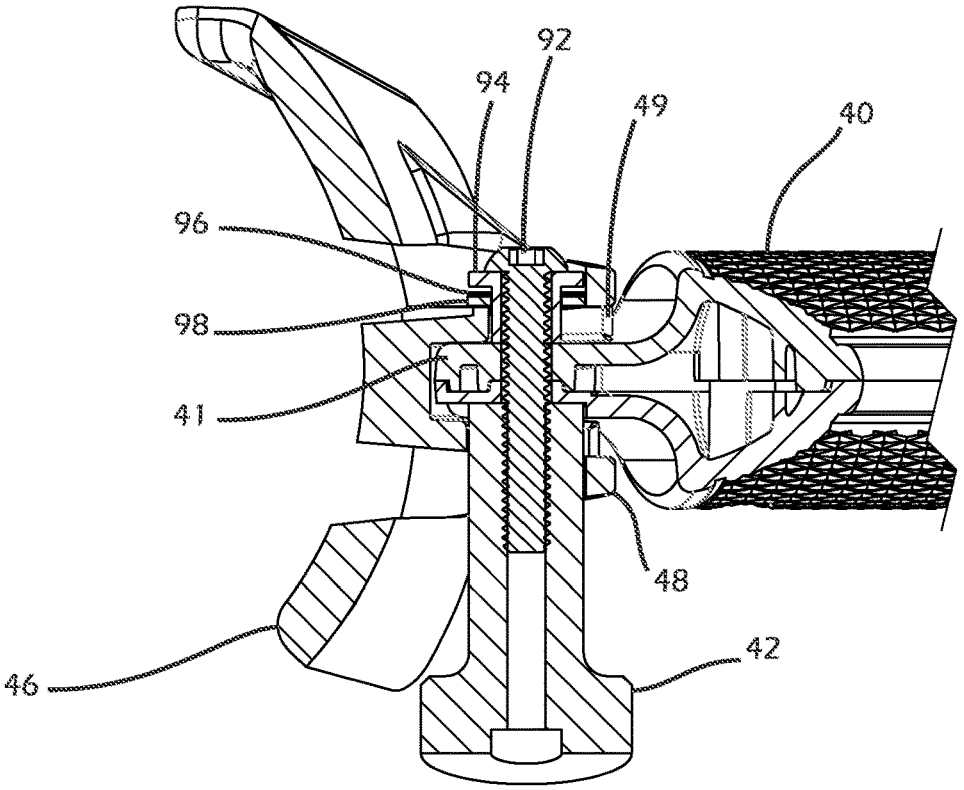
FIG. 10A is a sectional view taken along line 10A-10A of FIG. 10.

With respect to rotation of the cuffs 46, 56, FIG. 9 is an exploded perspective view of the cuff 46 to illustrate its attachment to the side handle 40. FIG. 10 is an enlarged view that illustrates attachment of the cuff 46 to the side handle 40, and FIG. 10A is a sectional view taken along line 10A-10A of FIG. 10. As shown in FIGS. 9, 10, and 10A, in this exemplary embodiment, the cuff 46 includes a clevis 47 on it rear surface that has a first portion 48 and a second portion 49. Each of the first portion 48 and the second portion 49 define a central hole 48*a*, 49*a*. The side handle 40 includes a projection (or tang) 41 which fits in the cavity between the first portion 48 and the second portion 49 of the clevis 47, and this projection 41 also defines a central hole 41*a*. When assembled, the respective holes 48*a*, 49*a* defined by the first portion 48 and the second portion 49 of the clevis 47 are aligned with the hole 41*a* defined by the projection 41, such that a pin 92 can be inserted through the aligned holes 48*a*, 49*a*, 41*a* to connect the cuff 46 to the side handle 40, while still allowing the cuff 46 to rotate relative to the side handle 40 about the axis defined by the pin 92.

Referring still to FIGS. 9, 10, and 10A, in this exemplary embodiment, the pin 92 is a threaded bolt, which passes through the aligned holes 48*a*, 49*a*, 41*a* and is threaded into the attachment post 42. As described above, the attachment post 42 has a wide flange for engaging the rear surface of the shield 100 (see FIG. 2) and defines a threaded hole 42*a* for receiving the bolt 76 to secure it to the shield 100. Furthermore, in this exemplary embodiment, the pin 92 passes through a cuff bushing 94, a wave washer 96, and a flat washer 98 before its insertion through the aligned holes 48*a*, 49*a*, 41*a* and into the attachment post 42.

Although the first cuff 46 was illustrated and described above with respect to FIGS. 9, 10, and 10A, the second cuff 56 is similarly constructed and attached to the handle assembly 20. Furthermore, such construction and attachment of the cuffs 46, 56 to the handle assembly 20 is provided solely for purposes of example, and other means could be used to accomplish the desired rotation of the cuffs 46, 56 relative to the handle assembly 20 without departing from the spirit and scope of the present invention.

One of ordinary skill in the art will recognize that additional embodiments are also possible without departing from the teachings of the present invention. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A handle and lighting system for a tactical shield, comprising:

a handle assembly configured to be mounted on a rear surface of the tactical shield, the handle assembly including a central horizontal handle, a first side handle on one side of the central horizontal handle, and a second side handle on an opposite side of the central horizontal handle, such that, in use, the tactical shield can be held by an operator in a vertical-hold orientation by grasping the central horizontal handle or in a cross-hold orientation by grasping either the first side handle or the second side handle;

a lighting enclosure configured to be mounted on a front surface of the tactical shield, the lighting enclosure including one or more light sources; and a power source for the one or more light sources housed in the handle assembly;

wherein the power source is electrically connected to a first contact, which is positioned on an exterior surface of the handle assembly, and wherein the power source is electrically connected to a second contact, which is also positioned on an exterior surface of the handle assembly;

wherein the handle assembly includes a first attachment block at a first end of the central horizontal handle and a second attachment block at a second end of the central horizontal handle, each of the first and second attachment blocks defining and enclosing a threaded hole configured to receive a bolt for securing the lighting enclosure to the handle assembly through the tactical shield; and wherein the first contact positioned on the exterior surface of the handle assembly is secured to the first attachment block, and wherein the second contact positioned on the exterior surface of the handle assembly is secured to the second attachment block.

2. The handle and lighting system for a tactical shield as recited in claim 1, wherein the one or more light sources are light-emitting diodes.

3. The handle and lighting system for a tactical shield as recited in claim 1, wherein a first contact is secured to the lighting enclosure, and a second contact is secured to the lighting enclosure, with each of the first contact and the second contact electrically connected to the one or more light sources; and wherein, when mounted to the tactical shield, a first spring bridges and connects the first contact positioned on the exterior surface of the handle assembly and secured to the first attachment block to the first contact that is secured to the lighting enclosure, and a second spring bridges and connects the second contact positioned on the exterior surface of the handle assembly and secured to the second attachment block to the second contact that is secured to the lighting enclosure, such that the power source is electrically connected to the one or more light sources.

4. The handle and lighting system for a tactical shield as recited in claim 1, wherein a first switch is mounted on the central horizontal handle, a second switch is mounted near a top of the first side handle, and a third switch is mounted near a top of the second side handle, wherein each of the first switch, the second switch, and the third switch is electrically connected to and can be used to activate the one or more light sources, and each of the first switch, the second switch, and the third switch can also be used to deactivate the one or more light sources.

5. The handle and lighting system for a tactical shield as recited in claim 4, wherein the first switch is a metal-over-capacitive touch (MOCT) switch.

6. The handle and lighting system for a tactical shield as recited in claim 5, wherein the second switch and the third switch are each momentary spring-loaded mechanical switches.

7. A tactical shield system, comprising:

a shield;

a handle assembly mounted on a rear surface of the shield, the handle assembly including a central horizontal handle, a first side handle on one side of the central horizontal handle, and a second side handle on an opposite side of the central horizontal handle, such that, in use, the shield can be held by an operator in a vertical-hold orientation by grasping the central horizontal handle or in a cross-hold orientation by grasping either the first side handle or the second side handle, and the handle assembly further including a first switch mounted on the central horizontal handle, a second switch mounted near a top of the first side handle, and a third switch mounted near a top of the second side handle;

a lighting enclosure mounted on a front surface of the shield by one or more fasteners that extend through the lighting enclosure, through the shield, and into the handle assembly, the lighting enclosure including one or more light sources; and a power source for the one or more light sources housed in the handle assembly;

wherein each of the first switch, the second switch, and the third switch is electrically connected to and can be used to activate the one or more light sources, and each of the first switch, the second switch, and the third switch can also be used to deactivate the one or more light sources;

wherein the power source is electrically connected to a first contact, which is positioned on an exterior surface of the handle assembly, and wherein the power source is electrically connected to a second contact, which is also positioned on an exterior surface of the handle assembly;

wherein the handle assembly includes a first attachment block at a first end of the central horizontal handle and a second attachment block at a second end of the central horizontal handle, each of the first and second attachment blocks defining and enclosing a threaded hole configured to receive a bolt for securing the lighting enclosure to the handle assembly through the tactical shield; and wherein the first contact positioned on the exterior surface of the handle assembly is secured to the first attachment block, and wherein the second contact positioned on the exterior surface of the handle assembly is secured to the second attachment block.

8. The tactical shield system as recited in claim 7, wherein the one or more light sources are light-emitting diodes.

9. The tactical shield system as recited in claim 7, wherein the handle assembly further includes a first attachment post at a lower distal end of the first side handle and a second attachment post at a lower distal end of the second side handle, with each of the first and second attachment posts engaging the rear surface of the shield and defining a threaded hole that receives a lower bolt, thus further securing the handle assembly to the shield.

10. The tactical shield system as recited in claim 7, wherein a first contact is secured to the lighting enclosure, and a second contact is secured to the lighting enclosure, with each of the first contact and the second contact electrically connected to the one or more light sources.

11. The tactical shield system as recited in claim 10, wherein a first spring bridges and connects the first contact positioned on the exterior surface of the handle assembly to the first contact that is secured to the lighting enclosure, and a second spring bridges and connects the second contact positioned on the exterior surface of the handle assembly to the second contact that is secured to the lighting enclosure, such that the power source is electrically connected to the one or more light sources through the shield.

12. The tactical shield system as recited in claim 7, wherein the first switch is a metal-over-capacitive touch (MOCT) switch.

13. The tactical shield system as recited in claim 12, wherein the second switch and the third switch are each momentary spring-loaded mechanical switches.

* * * * *